US006178560B1

(12) United States Patent
Halstead et al.

(10) Patent No.: US 6,178,560 B1
(45) Date of Patent: Jan. 30, 2001

(54) HELMET FITTING SYSTEM

(75) Inventors: Peter David Halstead; Cherie F. Alexander, both of Knoxville, TN (US)

(73) Assignee: Southern Impact Research Center, LLC

( * ) Notice: Under 35 U.S.C. 154(b), the term of this patent shall be extended for 0 days.

(21) Appl. No.: 09/326,418

(22) Filed: Jun. 4, 1999

(51) Int. Cl.[7] ..... A42B 3/12
(52) U.S. Cl. ..... 2/413
(58) Field of Search ..... 2/410, 411, 412, 2/413, 414, 417, 418, 419, 425, 183, DIG. 3; 36/29

(56) References Cited

U.S. PATENT DOCUMENTS

| | | | | |
|---|---|---|---|---|
| 2,816,290 | * | 12/1957 | Boyer | 2/413 |
| 3,609,764 | | 10/1971 | Morgan . | |
| 3,668,704 | * | 6/1972 | Conroy et al. | 2/413 |
| 3,761,959 | | 10/1973 | Dunning . | |
| 3,849,801 | * | 11/1974 | Holt et al. | 2/413 |
| 3,956,773 | | 5/1976 | Chisum . | |
| 4,023,213 | * | 5/1977 | Rovani | 2/413 |
| 4,060,855 | * | 12/1977 | Rappleyea | 2/413 |
| 4,100,320 | | 7/1978 | Chisum . | |
| 4,287,613 | | 9/1981 | Schulz . | |
| 4,375,108 | * | 3/1983 | Gooding | 2/413 |
| 4,566,137 | | 1/1986 | Gooding . | |
| 5,014,365 | | 5/1991 | Schulz . | |
| 5,035,009 | * | 7/1991 | Wingo, Jr. et al. | 2/414 |
| 5,175,889 | | 1/1993 | Infusino . | |
| 5,263,203 | | 11/1993 | Kraemer et al. . | |
| 5,830,553 | | 11/1998 | Huang . | |

* cited by examiner

*Primary Examiner*—Michael A. Neas
(74) *Attorney, Agent, or Firm*—Luedeka, Neely &Graham PC

(57) ABSTRACT

A fit system positionable adjacent interior portions of a helmet and cranial surfaces of a cranium of a wearer of the helmet proximate the interior portions of the helmet for improving the fit of the helmet to the cranium. The system includes an elongate fluid impervious bladder having a first end including an inlet port in fluid communication with the bladder and a second end remote from the first end. The bladder defines a single continuous fluid flowpath between the first end and the second end for receiving fluid introducible into the bladder through the inlet port for expanding the bladder so that substantially the entire length of the bladder may be expanded to engage mutually facing portions of the cranium of the user and interior portions of the helmet. The bladder is positionable within the helmet so as to substantially wrap around side portions of the cranium, temple areas of the cranium, a rear occipital protuberance portion of the cranium and an upper portion of the cranium without compromising the fluid flow path.

8 Claims, 15 Drawing Sheets

HELMET FITTING SYSTEM

FIELD OF THE INVENTION

This invention relates generally to helmets and more particularly to a device and method for fitting helmets to the craniums of users.

BACKGROUND AND SUMMARY OF THE INVENTION

Helmets, such as football helmets often include a high impact polymer shell and a shock absorbing component interior the shell. For mass produced helmets, the shells and shock absorbing components typically are provided in standard sizes, e.g., small, medium and large. To account for variances in head or cranium size, shape and the like within a size, a fitting component may be provided to adjust the fit of the helmet.

The present invention relates to an improved fitting component that overcomes disadvantages of prior fitting components and offers improved fit, comfort and ease of use for the user.

Accordingly, it is an object of the invention to provide a system for fitting of helmets to craniums.

Another object of the invention is to provide a system of the character described that is of one piece construction.

An additional object of the invention is to provide a system of the character described that enables custom fitting for individual users.

Yet another object of the invention is to provide a system of the character described that can be manufactured from a blank yet which enables fluid to be introduced via a flow path that does not become blocked or otherwise obstructed when the fit system is positioned about the cranium of a user.

A further object of the invention is to provide a system of the character described that enables fluid to be introduced via a single flow path for expanding the fit system a desired amount.

A still further object of the invention is to provide a system of the character described that enables fluid to be introduced via one or more discrete flow paths for expanding the fit system a desired amount.

It is another object of the invention to provide a helmet that incorporates fit systems in accordance with the invention and methods for fitting such helmets to users.

A further object of the invention is to provide a fit system of the character described that is uncomplicated in configuration and convenient to use.

With regard to the foregoing, the present invention is directed to a fit system positionable adjacent interior portions of a helmet and cranial surfaces of a cranium of a wearer of the helmet proximate the interior portions of the helmet for improving the fit of the helmet to the cranium.

The system includes an elongate fluid impervious bladder having an inlet end including an inlet port in fluid communication with the bladder and a terminal end distal from the inlet end. The bladder defines a single continuous fluid flowpath between the inlet end and the terminal end for receiving fluid introducible into the bladder through the inlet port for expanding the bladder so that substantially the entire length of the bladder may be expanded to engage portions of the cranium of the user and interior portions of the helmet.

In another aspect, the fit system includes an elongate pliable member that is substantially M-shaped when positioned in a planar orientation and positionable in a non-planar relationship within a helmet so as to substantially wrap around side portions of the cranium, temple areas of the cranium, a rear occipital protuberance portion of the cranium and an upper portion of the cranium.

The invention also provides a blank for manufacture of the fit system and having a first fluid impervious sheet material overlying a second fluid impervious material, with selected substantially continuous portions of the first and second sheet materials being sealed together to define a single fluid path that provides an elongate substantially M-shaped cavity for receiving a fluid for expanding the cavity.

In still another aspect, the invention provides a method of fitting a helmet to a cranium.

In a preferred embodiment, the method includes the steps of providing a helmet comprising a shell having a shock attenuation liner adjacent an interior portion of the shell and a fit system adjacent the interior portion for contacting portions of the cranium. The fit system includes an elongate fluid impervious bladder having a first end including an inlet port in fluid communication with the bladder and a second end remote from the first end. The bladder defines a single continuous fluid flowpath between the first end and the second end for receiving fluid introducible into the bladder through the inlet port for expanding the bladder to engage adjacent portions of the cranium of the user and interior portions of the helmet. The bladder is positionable within the helmet so as to substantially wrap around portions of the cranium without compromising the fluid flow path.

Next, the helmet is positioned on the cranium of the user such that the fit system substantially wraps around portions of the cranium without compromising the fluid flow path. Fluid is then introduced into the bladder via the inlet port to desirably expand the fit system to engage adjacent portions of the cranium of the user and the liner of the helmet.

In still another embodiment, the invention relates to a fit system including a pair of elongate fluid impervious bladders. Each bladder includes a first end including an inlet port in fluid communication with the bladder and a second end remote from the first end. Each bladder defines a single continuous fluid flowpath between the first end and the second end for receiving fluid introducible into the bladder through the inlet port for expanding the bladder so that substantially the entire length of the bladder may be expanded to engage portions of the cranium of the user and interior portions of the helmet.

The invention advantageously enables fitting a helmet to a cranium of a user to enhance comfort and aids in maintaining the helmet desirably positioned on the cranium of the user.

BRIEF DESCRIPTION OF THE DRAWINGS

The above and other features and advantages of the present invention will become further known from the following detailed description considered in conjunction with the accompanying drawings in which.

DETAILED DESCRIPTION

FIGS. 1–8

Figure 1:
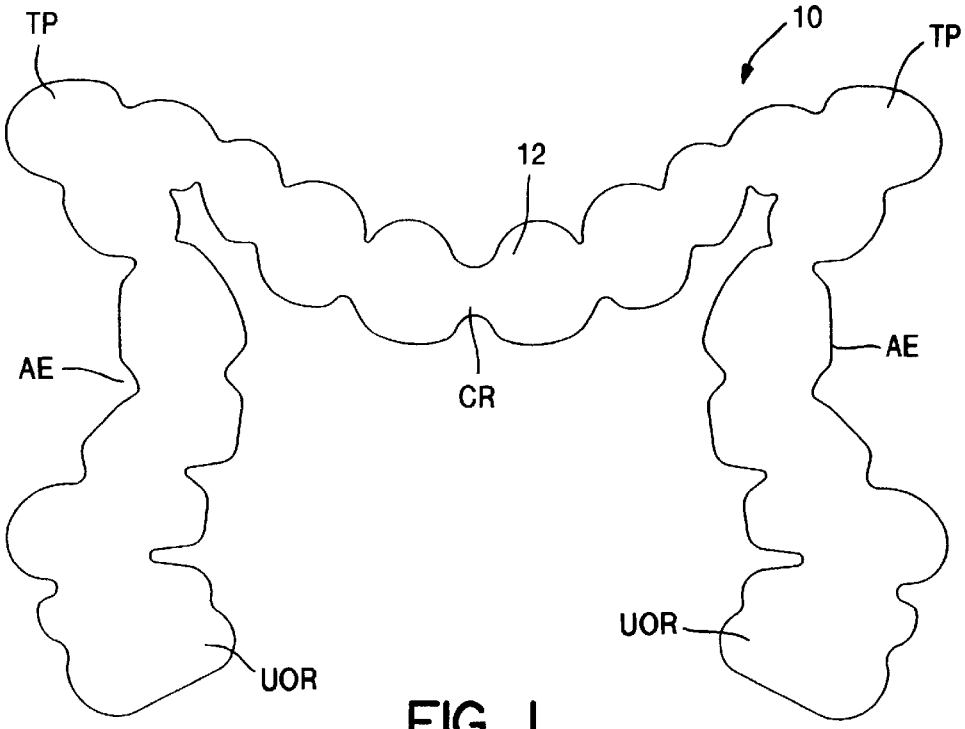
FIG. 1 is top plan view of a fit system in accordance with a preferred embodiment of the invention.
Figure 2:
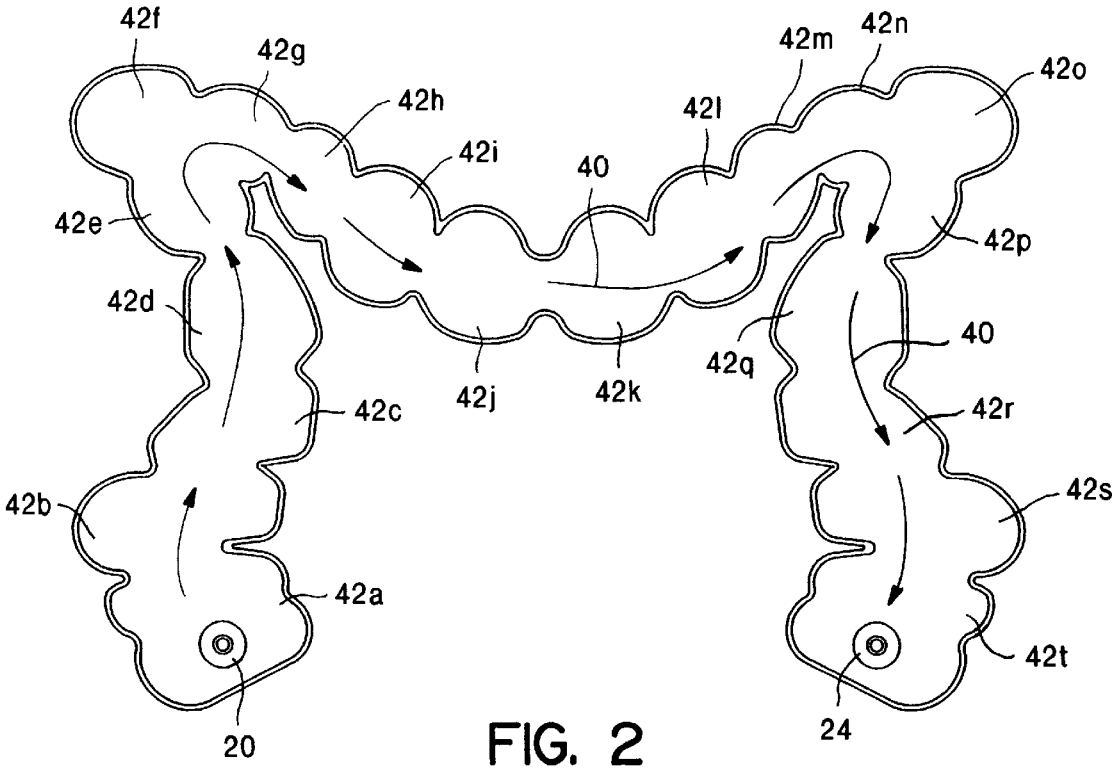
FIG. 2 is a bottom plan view of the fit system of FIG. 1.
Figure 3:
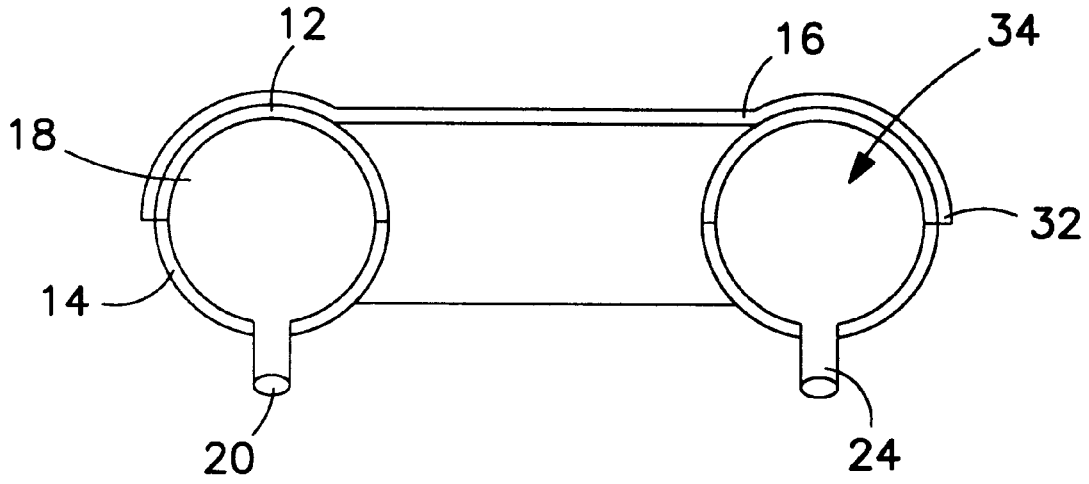
FIG. 3 is a cross-sectional end view of the fit system of FIG. 1 taken along line 3—3.
Figure 5:
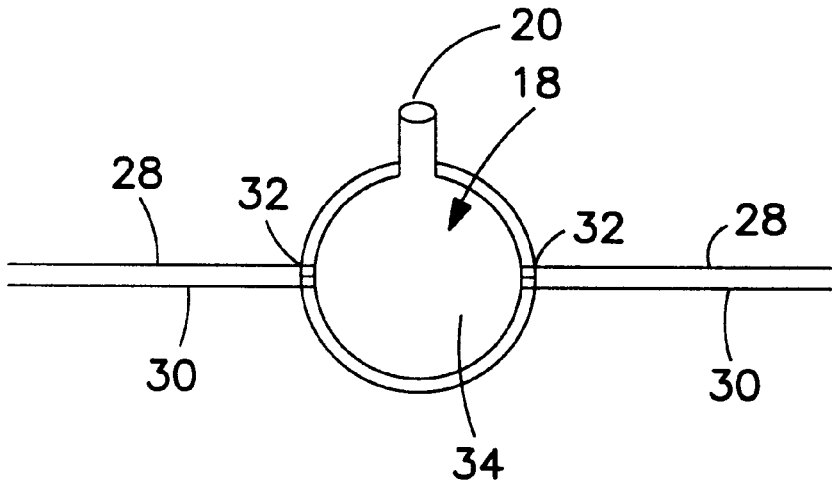
FIG. 5 is a cross-sectional view taken along line 5—5 of FIG. 4.

With initial reference to FIGS. 1–3, there is shown a fit system 10 for use with a helmet for fitting an interior portion of the helmet to a cranium of a user to reduce slippage between the cranium of the user and the helmet, to assist in maintaining the helmet in place on the cranium and to avoid discomfort to the user. The fit system 10 enables a medium to be introduced in a fluid state to void spaces between the interior of the helmet and the cranium to fill or partially fill the void spaces as desired. The medium is flowably introduced through a single, serpentine flow path located between the interior of the helmet and the cranium of the user while the helmet is worn on the cranium. The configuration of the flow path enables a substantially equal pressure to be exerted by the fluid against the cranium of the user regardless of the area of the flow path at a given location of the flow path.

The fit system 10 preferably includes a first portion 12 of a fluid impervious material overlying a second portion 14 of a fluid impervious material. The first layer 12 and the bottom layer 14 are preferably made of a relatively flexible and fluid impervious plastic sheet material, such as vinyl.

The first portion 12 and the second portion 14 are fixedly attached to one another to provide a substantially impervious bladder 18 therebetween for receiving a fluid. The fluid is preferably either a gas such as air, gels, liquids such as water, or curable liquids, such as liquid-based foams that cure or set into a solid form, such as polyurethane foam.

As shown in FIG. 3, the first portion 12 preferably has a thin layer 16 of a soft material exterior to the bladder, such as nylon, velo, moleskin, or other soft, flexible fabric, secured thereto as by adhesive for contacting the cranium of the user.

An inlet port 20 is located at an inlet end 22 of the bladder 18 for introducing fluid into the bladder 18. An outlet port 24 is preferably provided at a outlet or terminal end 26 of the bladder 18 when a curable liquid fluid is to be introduced into the bladder 18 for enabling the fluid to flow out of the bladder 18 during filling. For example, a liquid foam is preferably flowed through the bladder 18 from inlet end 22 to outlet end 26 until fluid is observed to flow out of the port 24. The presence of fluid exiting the bladder through the port 24 indicates that the bladder is substantially uniformly expanded with the fluid.

In the use of non-setting fluids, e.g., gas, gels and liquids that do not change state and maintain their fluidity, the outlet port 24 is preferably not included or is provided with a seal and the inlet port 20 preferably includes a suitable valve arrangement that enables fluid to be introduced into the bladder 18 through the port and to inhibit introduced fluid from exiting the bladder 18 back through the port 20.

Figure 4:
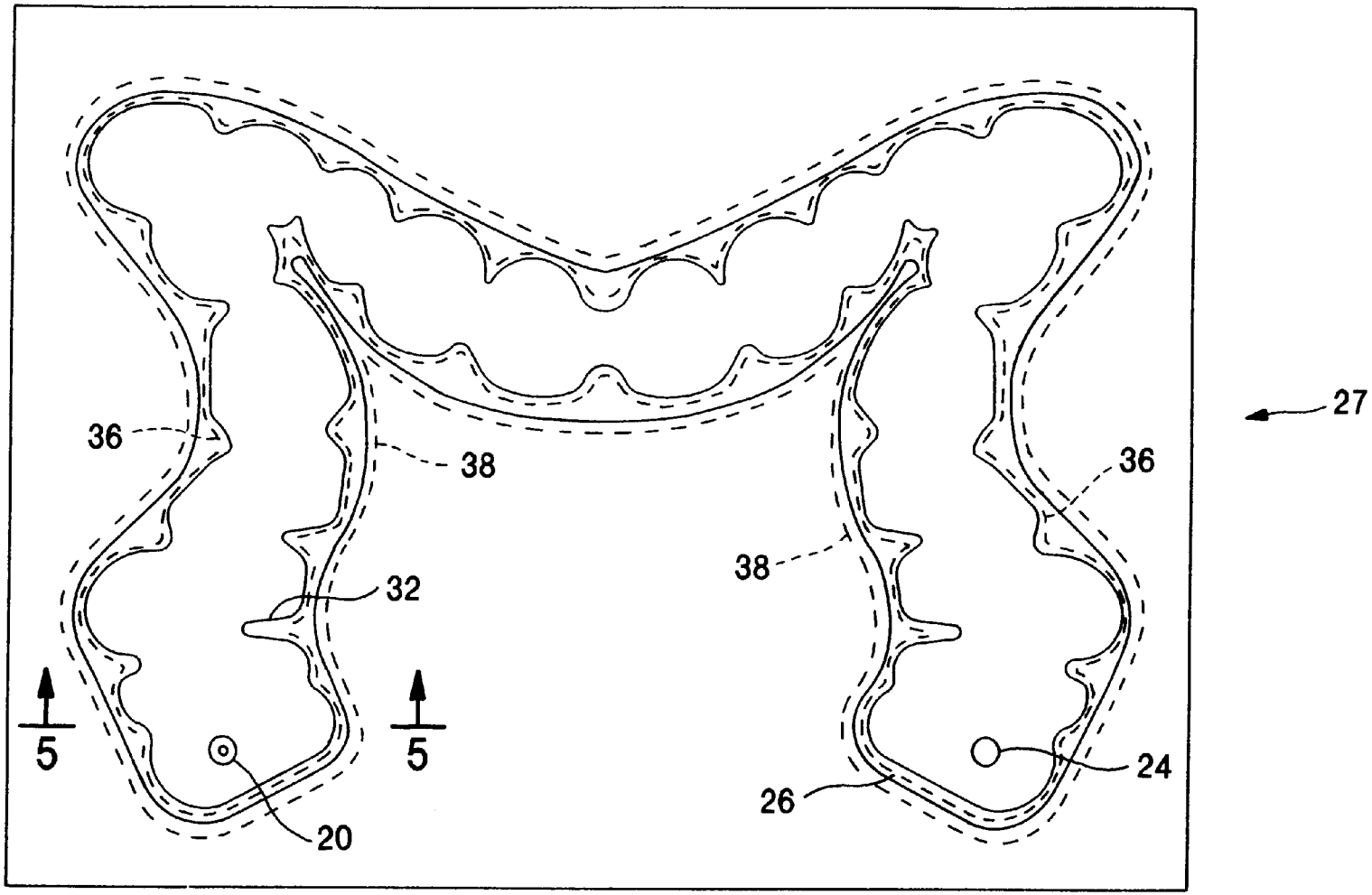
FIG. 4. is a top plan view of a blank for providing the fit system of FIG. 1

The fit system 10 may be manufactured using a blank 27 as shown in FIGS. 4 and 4*a*. Sheets 28 and 30 of material representing portions 12 and 14, respectively are placed in an adjacent orientation. A seal, such as a heat seal, is applied to a selected continuous region of the sheets to bond facing portions of the sheets together in a sealing relationship that defines a seal or border 32 that surrounds a cavity area 34. The cavity area 34 defines the bladder 18. Material surrounding the border 32 or material of the border 32 may be trimmed, as by cutting along dashed line 36 or dashed line 38, to remove excess material as desired.

Returning to FIG. 2, the bladder 18 of the fit system 10 defines a single, uninterrupted flow path (defined by arrows 40) extending between inlet 20 and outlet 24. The path defined by the arrows 40 traverses a plurality of individual and interconnected segments, such as segments 42*a*–42*t*, configured in a generally "M"-shaped arrangement when the bladder 18 is lying in a plane.

The configuration of the fit system 10 and its interconnected segments 42*a*–42*t* advantageously enables a single flow path that can be adapted to be positioned in a non-planar relationship without creasing or bending so as to compromise the flow path. That is, the interconnected segments 42*a*–42*t* cooperate with one another and enable the bladder 18 of the fit system 10 to be positioned about the cranium of the user and within the helmet and to receive fluid and expand the bladder 18, with the fluid pressure within the bladder being substantially uniform in each of the segments 42*a*–42*t*.

In this regard, it will be understood that the fit system 10 may have a greater or less number of segments depending on the size of the overall fit system and the size of each segment. That is, each segment may be smaller such that a greater number of segments is required to provide a fit system of desired size or each segment may be larger so that fewer segments are needed. The segments are preferably of substantially uniform size (and volume), however, it will be understood that segments of varying size may be utilized in conjunction with one another.

Figure 6:
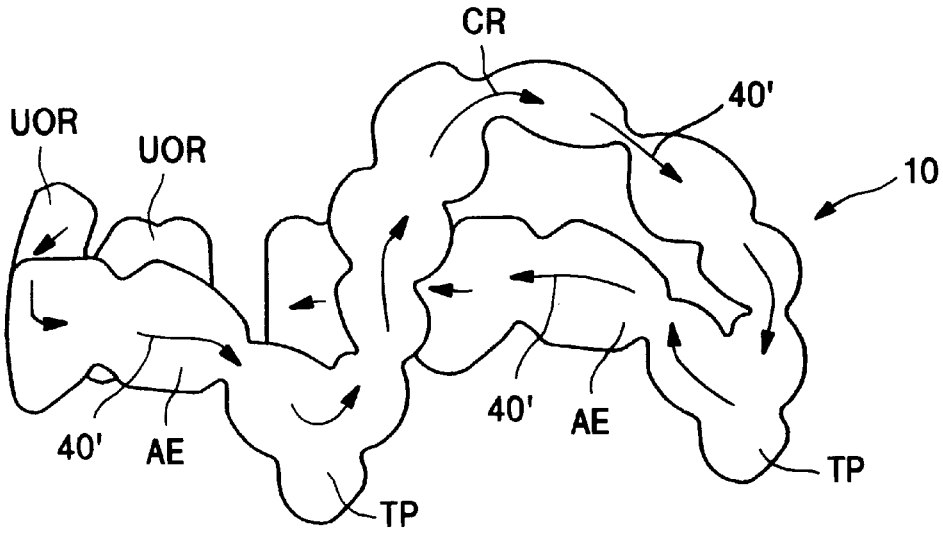
FIG. 6 is an exploded perspective view showing a fit system according to the invention and a cranium.
Figure 6:
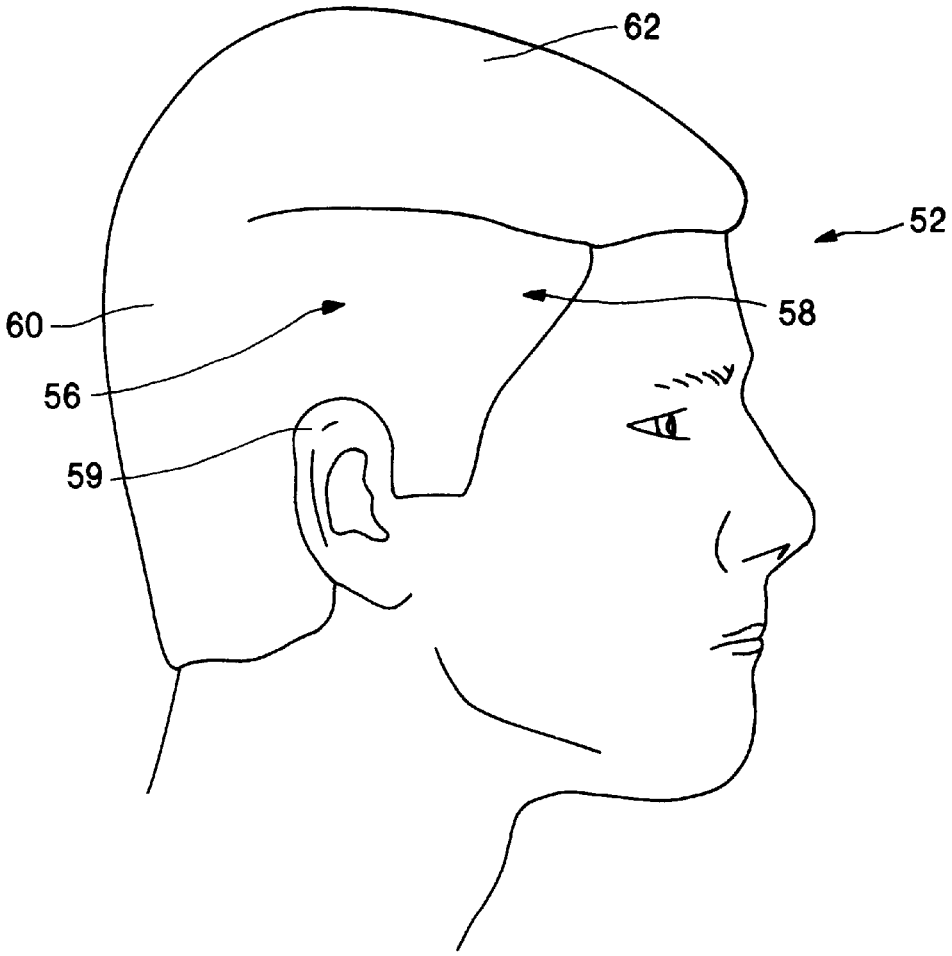
Figure 7:
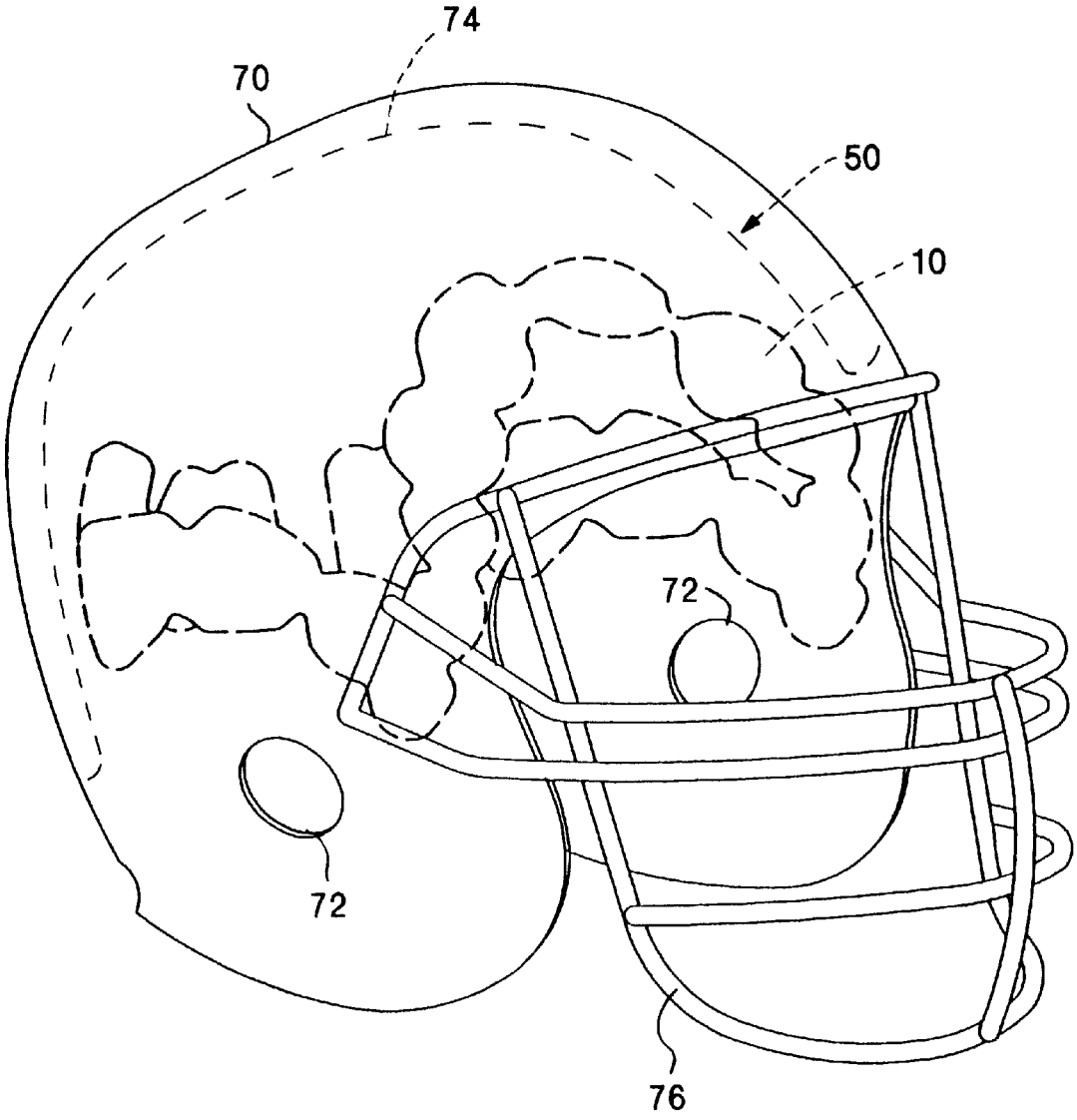
FIG. 7 is a perspective view showing a fit system according to the invention installed within a helmet shell.

With additional reference to FIGS. 6 and 7, the fit system 10 is configured for placement within an interior portion of a helmet, such as football helmet 50 for receiving a portion of a cranium 52 of a user. As oriented in FIG. 6, the fit system 10 has been placed desirably for placement about the cranium 52. The flow path, represented by arrows 40' is continuous and placement of the fit system 10 about the cranium 52 has not resulted in creases between segments or other blockage to flow.

The helmet 50 preferably includes a shell 70 having ear holes 72 and a shock attenuation liner 74 adjacent an interior portion of the shell 70. A face mask 76 is also preferably mounted to the shell 70, as by fasteners. The liner 74 may be secured to the interior of the shell 70 as by adhesive or mating hook and loop material or other fastening means. The fit system 10 is secured to the liner 74, preferably releasably secured as by hook and loop material, with the layer of soft material 16 positioned for contacting the cranium of a user.

The fit system 10 substantially wraps around the sides, temple areas 58 of the cranium, above ears 59, the rear occipital protuberance portion 60 of the cranium and an upper or crown portion 62 of the cranium 52. Upon introduction of fluid into the bladder 18, the fluid will travel along the flow path 40' and expand the bladder 18 so that it substantially occupies void areas or-gaps between the cranium and adjacent interior surfaces of the helmet. Contact of the fit system with the occipital protuberance 60 tends to urge the fit system and hence the entire helmet in a generally downward direction so as to draw the interior of the helmet closer to the cranium of the user.

The following designations referenced in the drawings with regard to portions of the fit system 10 identify particular portions of the cranium to be contacted by the fit system when installed:

| | |
|---|---|
| TP | Temples |
| AE | Above ear |
| UOR | Under occipital protuberance in the rear |
| CR | Crown |

Accordingly, it will be appreciated that the fit system 10 may be advantageously used to fit a helmet to a cranium of a user to enhance comfort and to aid in maintaining the helmet desirably positioned on the cranium of the user. In a preferred embodiment, the fit system 10 may be used to custom fit the helmet to the user. This may be accomplished by first placing the helmet system 70, with the fit system 10 substantially void of fluid, on the cranium of the user. Fluid may then be introduced into the fit system via the inlet port 20 to desirably expand the fit system so that substantially the entire length of the fit system engages mutually facing portions of the cranium of the user and the liner 74 of the helmet.

A desirable fit is achieved when the bladder is sufficiently expanded such that the user experience a snugness of the helmet against the cranium without feeling significant discomfort. In the case of non-curable fluids, such as air and water and the like, a valve mechanism associated with the port 20 inhibits the introduced fluid from exiting the bladder such that the desired pressure achieved by introducing the fluid is maintained. It will be understood that more or less fluid may be introduced and/or subsequently added or removed as desired.

When the introduced fluid is a curable liquid, such as a liquid-based foam that cures or sets into a solid form, the fluid is flowed into the bladder via the port 20 until fluid exits the bladder via the port 24. At that point, the flow of fluid is ceased and the user maintains the helmet in the desired position for several minutes while the fluid cures into a solid form. The curable liquid therefore provides a custom fit that maintains its shape substantially indefinitely.

Figure 8:
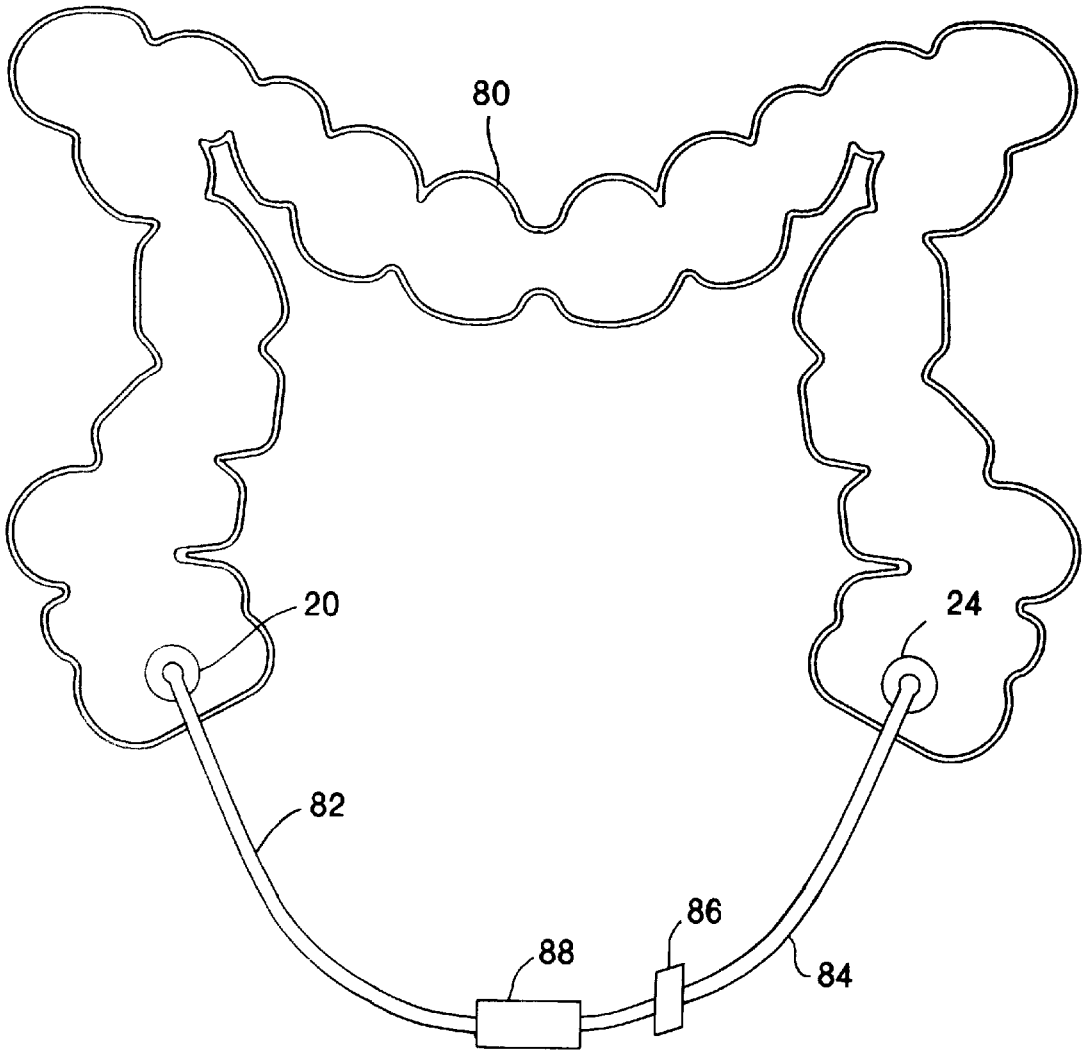
FIGS. 8 and 8*a* are top plan views of fit system in accordance with the invention having circulating fluid.
Figure 8A:
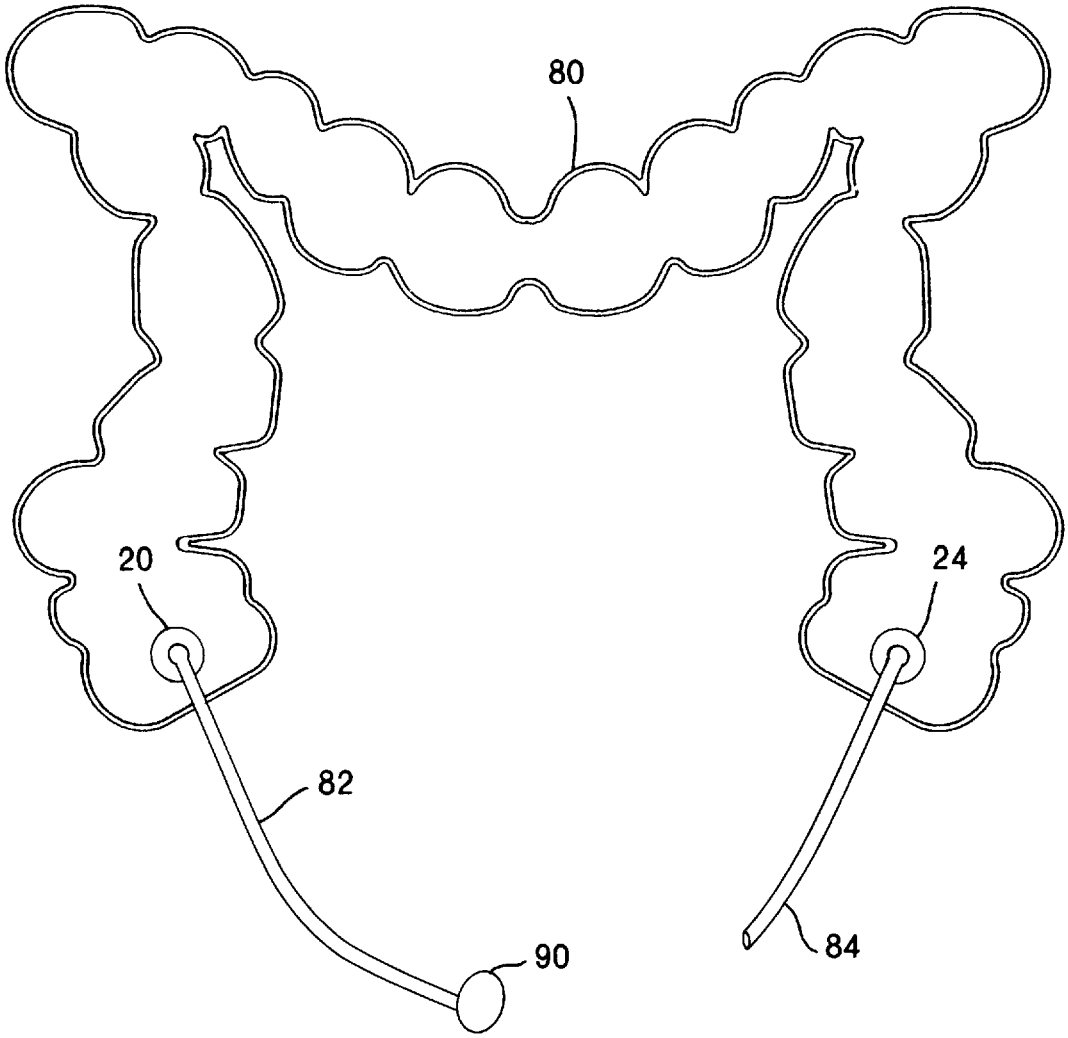

FIGS. 8 and 8*a* shows another embodiment of a fit system 80 in accordance with the invention. The fit system 80 is configured similar to the fit system 10, except that it includes tubing 82 and 84. In FIG. 8, one end of the tubing 82 is in fluid communication with the port 20 and one end of the tubing 84 is in fluid communication with the port 24. The opposite ends of tubing 82 and 84 connects to a circulator 86 for circulating fluid through the fit system.

For example, when the fluid is water, the circulator is preferably a water pump for recirculating the water through the flow path for cooling purposes. The water pump may be a small, battery powered unit that can be worn while the helmet is in use. A temperature control unit 88, such as a chiller or heater or heat exchanger, may also be incorporated in-line with the circulator for maintaining the fluid at a desired temperature. During cold weather, it is desirable to heat the fluid and in hot weather to cool the fluid.

Alternatively, as shown in FIG. 8*a*, the exit end of conduit 84 may be free to the atmosphere and the circulator 86 provided as by a source 90 of chilled or heated water for feeding a continuous supply of water through the system.

FIGS. 9–10

Figure 9:
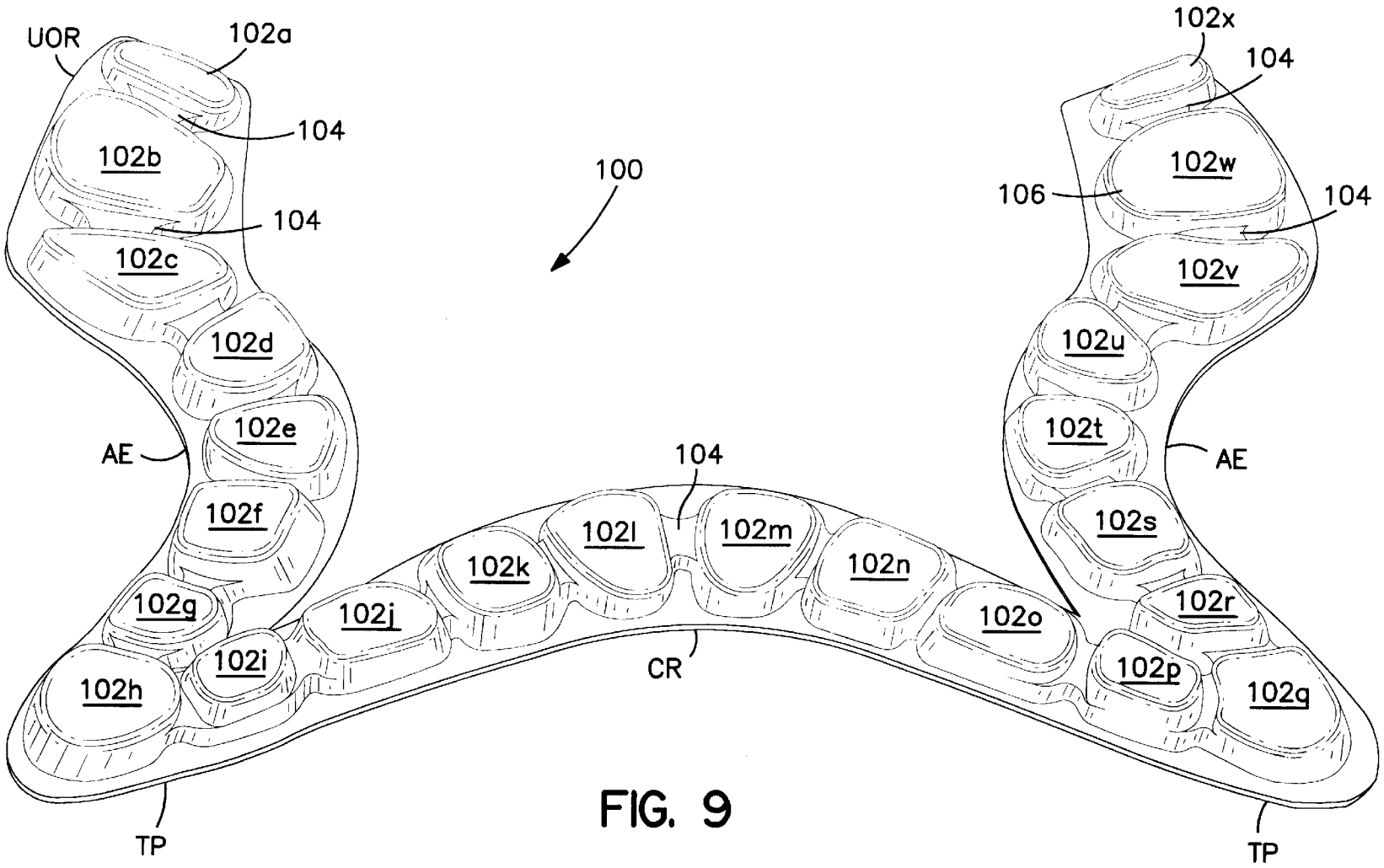
FIG. 9 is a perspective view showing a fit system according to another embodiment of the invention.
Figure 10:
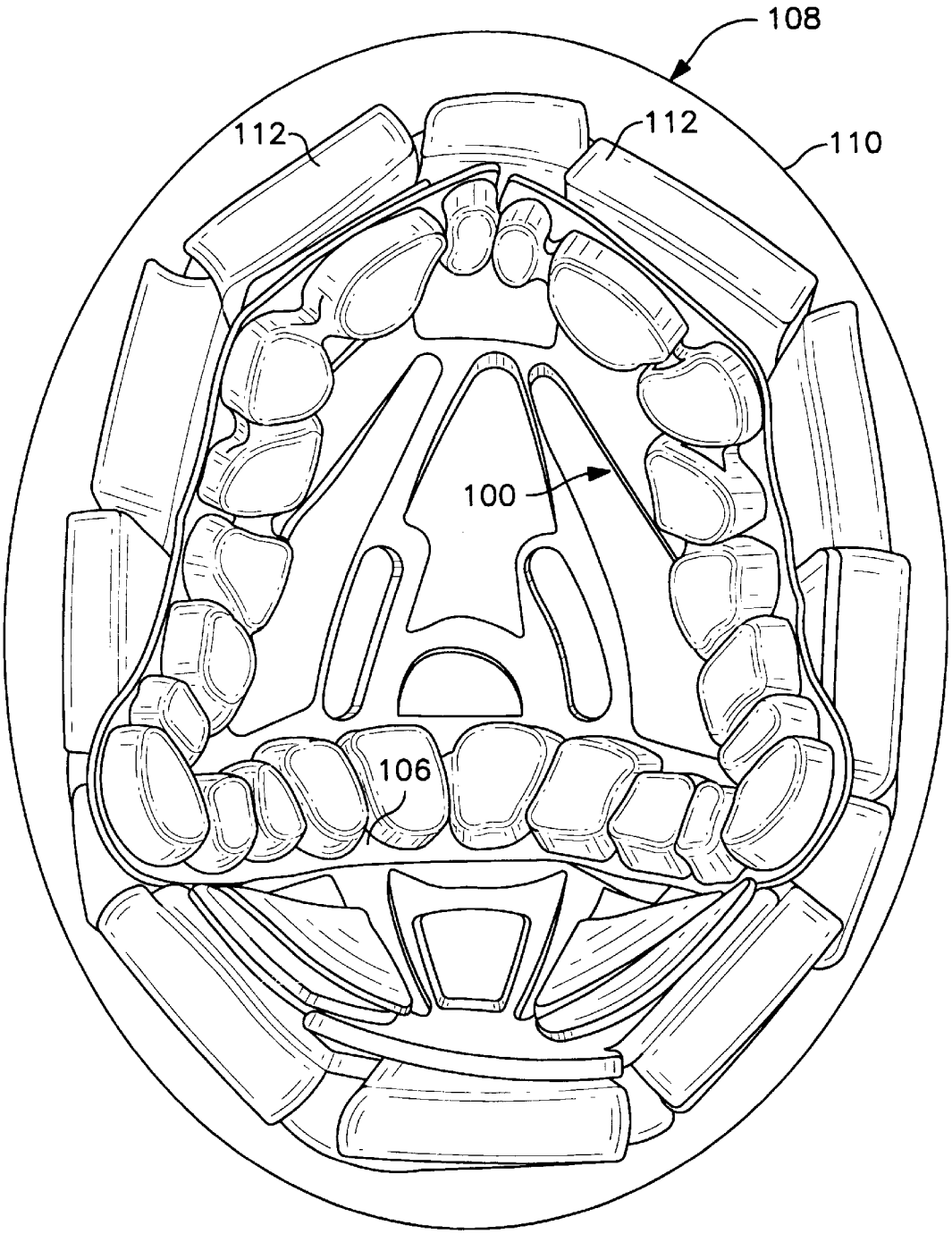
FIG. 10 is a bottom plan view showing the fit system of FIG. 8 installed within a helmet shell.

Turning now to FIGS. 9 and 10, there is shown an alternate embodiment of a fit system 100 having a shape generally conforming to that of the fit system 10 but of solid construction. For example, the fit system 100 may be made as by flowing foam through the blank of FIG. 4, letting the foam set and thereafter removing all of the material surrounding the set foam to yield a series of interconnected foam segments 102*a*–102*x*, with each adjacent segment being connected by a connecting portion 104. The segments 102*a*–102*x* are preferably secured, as by adhesive, to a flexible backing material 106.

As shown in FIG. 10, the fit system 100 may be incorporated (in the manner of the fit system 10) into a helmet system 108 having a shell 110 and a shock attenuation system or liner 112, with the backing material 106 being secured, as by hook and loop material, to the liner 112.

A preferred shell and shock attenuation system are described in U.S. application Ser. No. 09/325,827, naming as inventors P. David Halstead, Cherie F. Alexander and Thad Ide, filed on even date herewith and entitled HELMET, the entire disclosure of which is incorporated by reference.

FIGS. 11–20

Turning to FIGS. 11–20, there are shown various additional embodiments of fit systems in accordance with the invention. The following designations referenced in the drawings with regard to portions of the fit systems identify particular portions of the cranium to be contacted by the fit system when installed:

| | |
|---|---|
| TP | Temples |
| AE | Above ear |
| UOR | Under occipital protuberance in the rear |
| CR | Crown |
| MR | Middle of rear |
| FR | Front/forehead |

The embodiments shown in FIGS. 11–15 have single fluid paths and the embodiments of FIGS. 16–20 have a pair of discrete single flow paths. Each of the fit systems of FIGS. 11–20 is constructed similarly to the fit system 10 in that they are configured to provide a substantially impervious bladder for receiving a fluid.

Figure 11:
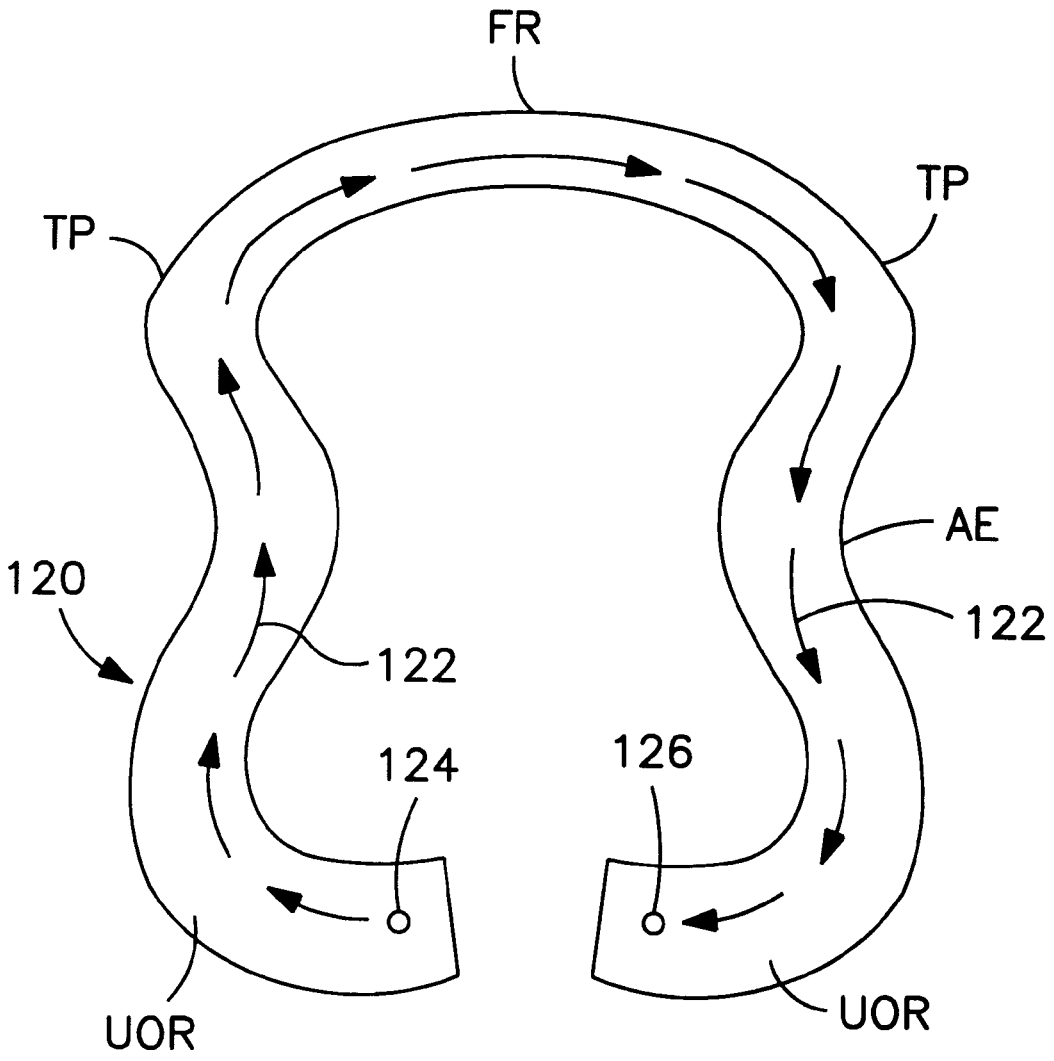
FIGS. 11–15 are plan views of alternate embodiments of fit systems in accordance with the invention having a single fluid flow path.
Figure 12:
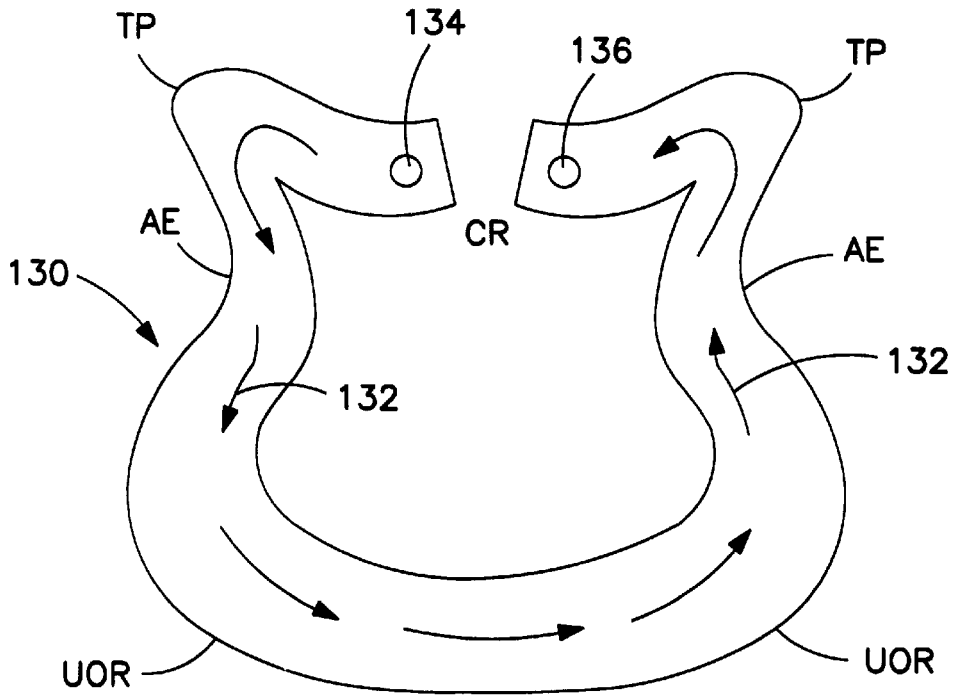
Figure 13:
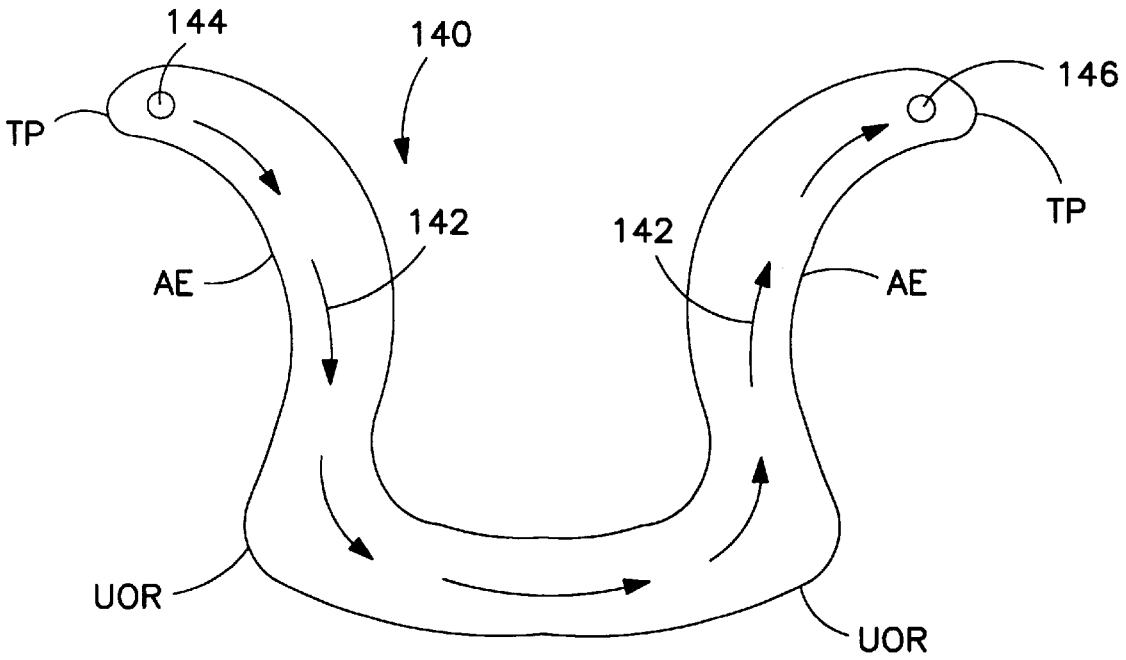
Figure 14:
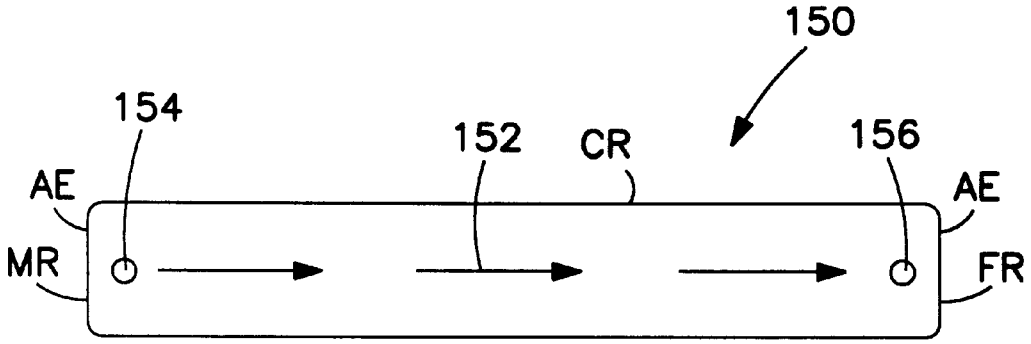
Figure 15:
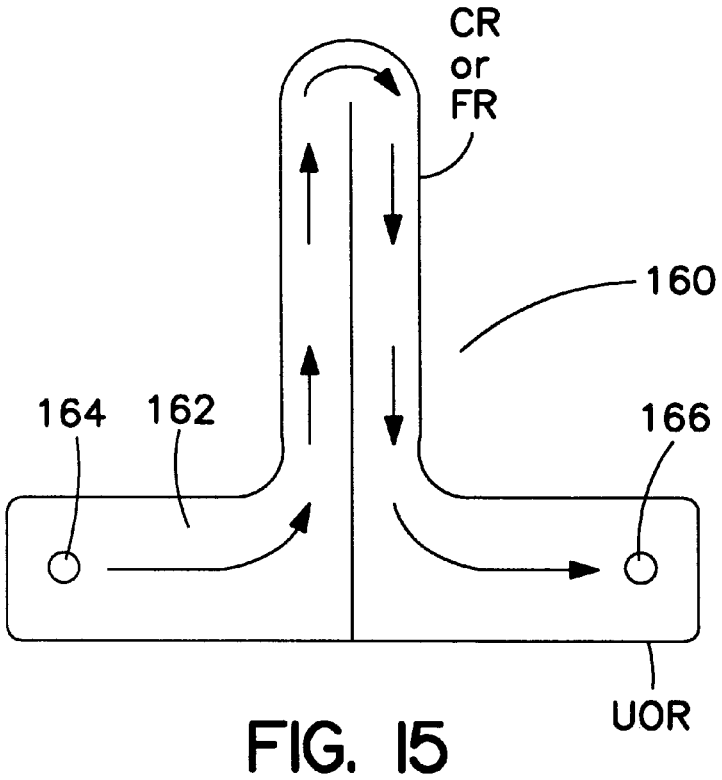

FIG. 11 shows a fit system 120 having a single flow path indicated by arrows 122 between an inlet port 124 and an outlet port 126. FIG. 12 shows a fit system 130 having a single flow path indicated by arrows 132 between an inlet port 134 and an outlet port 136. FIG. 13 shows a fit system 140 having a single flow path indicated by arrows 142 between an inlet port 144 and an outlet port 146. FIG. 14 shows a fit system 150 having a single flow path indicated by arrows 152 between an inlet port 154 and an outlet port 156. FIG. 15 shows a fit system 160 having a single flow path indicated by arrows 162 between an inlet port 164 and an outlet port 166.

Figure 16:
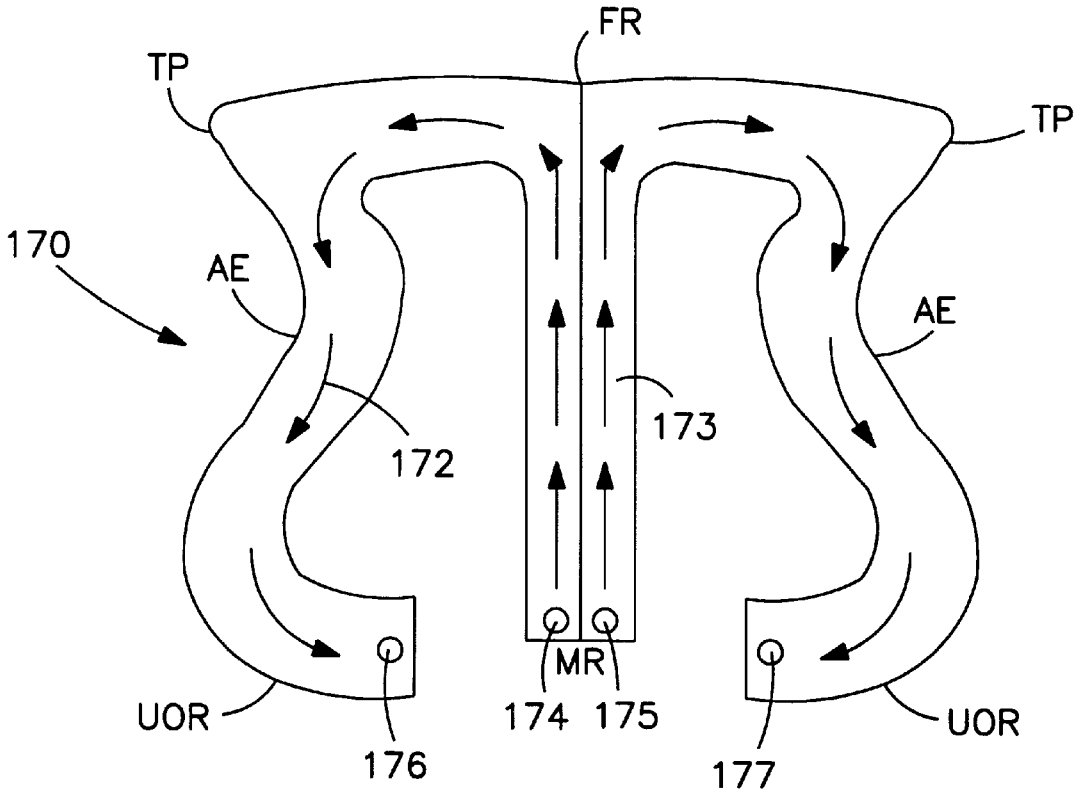
FIGS. 16–20 are plan views of alternate embodiments of fit systems in accordance with the invention having plural fluid flow paths.
Figure 17:
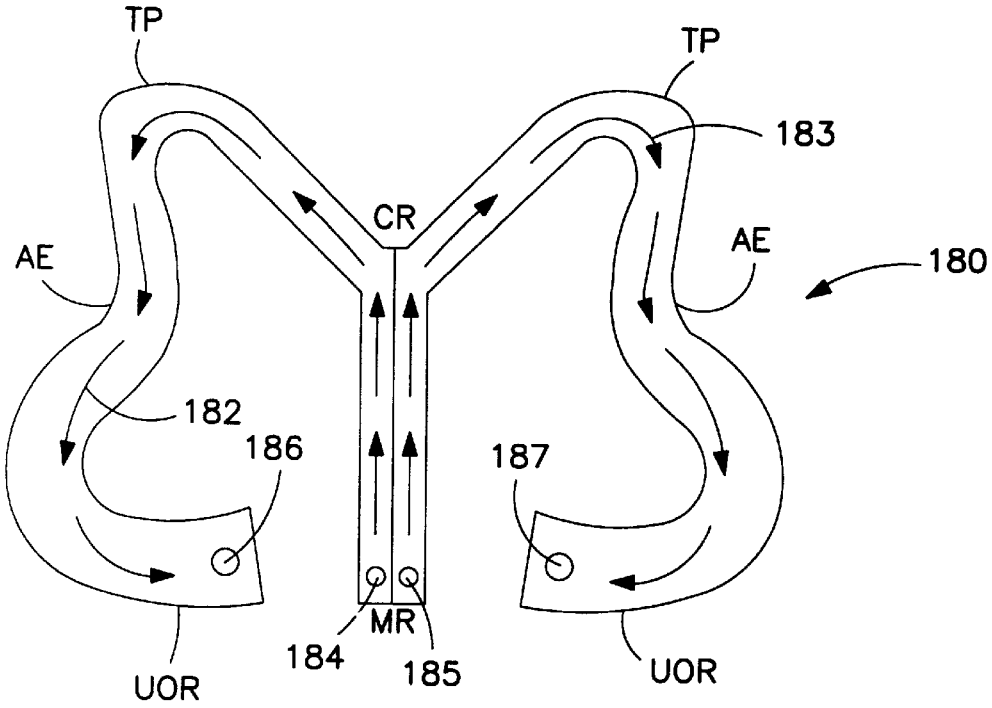
Figure 18:
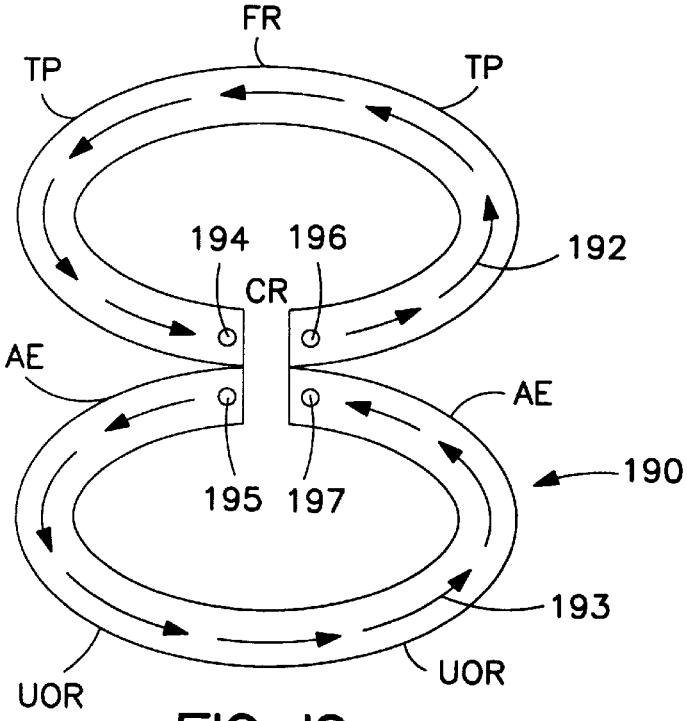
Figure 19:
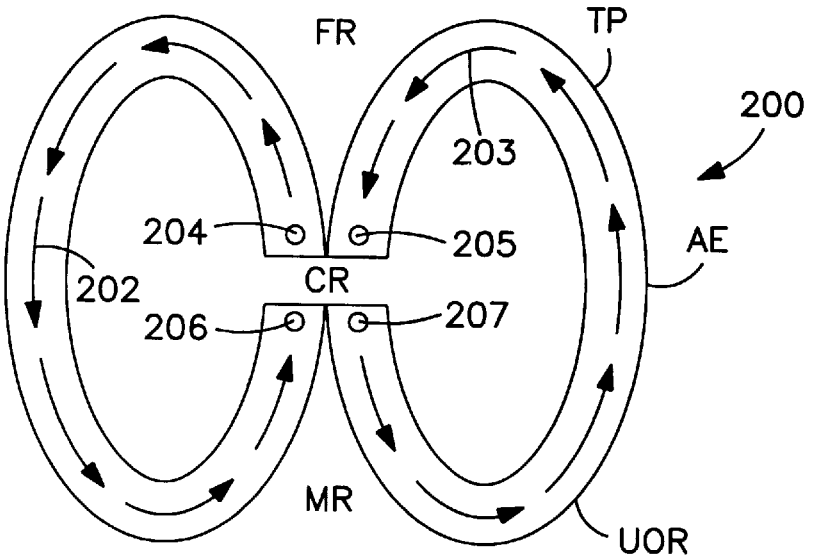
Figure 20:
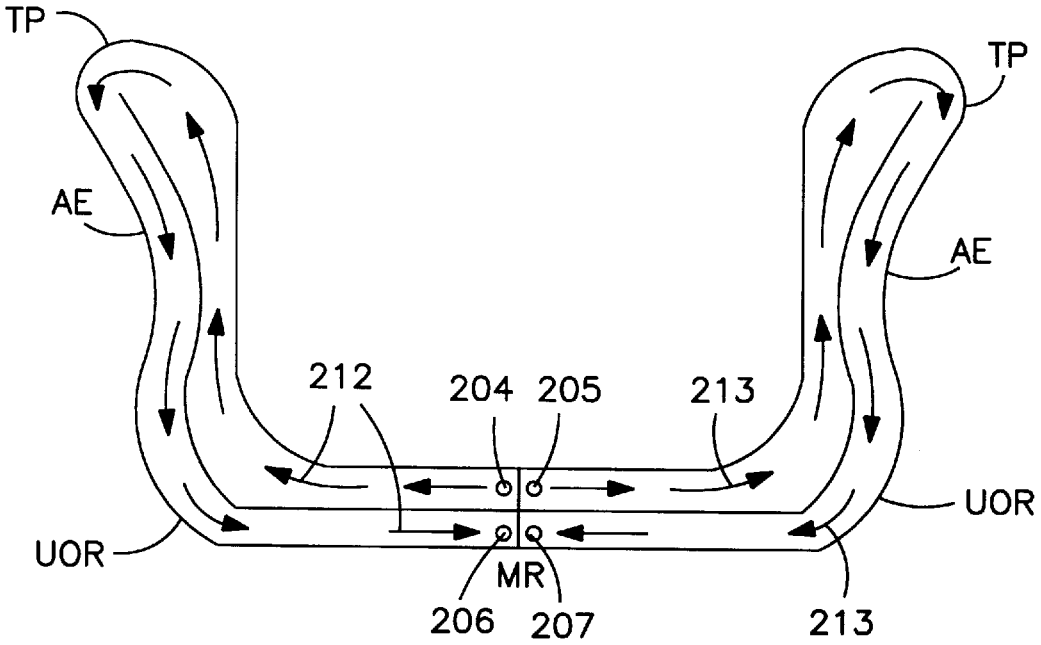

FIG. 16 shows a fit system 170 having a pair of discrete single flow paths indicated by arrows 172 and 173 between inlet ports 174, 175 and outlet ports 176, 177, respectively. FIG. 17 shows a fit system 180 having a pair of discrete flow paths indicated by arrows 182 and 183 between inlet ports 184, 185 and outlet ports 186, 187, respectively. FIG. 18 shows a fit system 190 having a pair of discrete flow paths indicated by arrows 192 and 193 between inlet ports 194, 195 and outlet ports 196, 197, respectively. FIG. 19 shows a fit system 200 having a pair of discrete flow paths indicated by arrows 202 and 203 between inlet ports 204, 205 and outlet ports 206, 207, respectively. FIG. 20 shows a fit system 210 having a pair of discrete flow paths indicated by arrows 212 and 213 between inlet ports 214, 215 and outlet ports 216, 217, respectively.

The foregoing description of certain embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A fit system positionable adjacent interior portions of a helmet and cranial surfaces of a cranium of a wearer of the helmet proximate the interior portions of the helmet for improving the fit of the helmet to the cranium, the system comprising an elongate fluid impervious bladder having a first end including an inlet port in fluid communication with the bladder and a second end remote from the first end, the bladder defining a single continuous fluid flowpath between the first end and the second end for receiving fluid introducible into the bladder through the inlet port for expanding the bladder so that substantially the entire length of the bladder may be expanded to engage mutually facing portions of the cranium of the user and interior portions of the helmet, the bladder being substantially M-shaped when positioned in a planar orientation and being positionable in a non-planar relationship within the helmet so as to substantially wrap around side portions of the cranium, temple areas of the cranium, a rear occipital protuberance portion of the cranium and an upper portion of the cranium without compromising the fluid flow path.

2. The system of claim 1, wherein the fluid is selected from the group consisting of gel, gas and liquid.

3. The system of claim 1 further comprising an outlet port adjacent the second end and in flow communication with the bladder and the atmosphere and the fluid comprises a curable liquid that sets into a solid form.

4. The system of claim 1, wherein the flowpath comprises a plurality of individual and interconnected segments.

5. A blank for manufacture of a fit system for helmet, the blank comprising a first fluid impervious sheet material overlying a second fluid impervious material, with selected substantially continuous portions of the first and second sheet materials being sealed together to define a single fluid path comprising an elongate substantially M-shaped cavity for receiving a fluid for expanding the cavity.

6. A fit system positionable adjacent interior portions of a helmet and cranial surfaces of a cranium of a wearer of the helmet proximate the interior portions of the helmet for improving the fit of the helmet to the cranium, the system comprising a pair of elongate fluid impervious bladders, each bladder having a first end including an inlet port in fluid communication with the bladder and a second end remote from the first end, each bladder defining a single continuous fluid flowpath between the first end and the second end for receiving fluid introducible into the bladder through the inlet port for expanding the bladder so that substantially the entire length of the bladder may be expanded to engage portions of the cranium of the user and interior portions of the helmet.

7. The fit system of claim 6, wherein the fluid is selected from the group consisting of gel, gas and liquid.

8. The fit system of claim 6 further comprising an outlet port adjacent the second end and in flow communication with the bladder and the atmosphere and the fluid comprises a curable liquid that sets into a solid form.

* * * * *